US005485596A

United States Patent [19]

Igarashi et al.

[11] Patent Number: 5,485,596

[45] Date of Patent: Jan. 16, 1996

[54] ABNORMALITY DIAGNOSTIC SYSTEM FOR EVAPORATIVE FUEL-PROCESSING SYSTEM OF INTERNAL COMBUSTION ENGINE FOR VEHICLES

[75] Inventors: Hisashi Igarashi; Masataka Chikamatsu; Hiroshi Maruyama; Masayoshi Yamanaka, all of Wako, Japan

[73] Assignee: Honda Giken Kogyo Kabushiki Kaisha, Tokyo, Japan

[21] Appl. No.: 20,831

[22] Filed: Feb. 22, 1993

[30] Foreign Application Priority Data

Mar. 2, 1992 [JP] Japan ..... 4-080485

[51] Int. Cl.[6] ..... F02M 33/02

[52] U.S. Cl. ..... 364/431.03; 364/424.03

[58] Field of Search ..... 123/500, 518, 123/520, 198 D, 479; 73/49.7; 364/431.01, 431.03, 431.06

[56] References Cited

U.S. PATENT DOCUMENTS

| | | | |
|---|---|---|---|
| 4,013,875 | 3/1977 | McGlynn | 364/424.07 |
| 4,497,057 | 1/1985 | Kato et al. | 371/29.1 |
| 4,949,695 | 8/1990 | Uranishi et al. | 123/520 |
| 5,056,026 | 10/1991 | Mitchell et al. | 364/424.03 |
| 5,085,194 | 2/1992 | Kuroda et al. | 123/479 |
| 5,143,035 | 9/1992 | Kayanuma | 123/198 D |
| 5,146,902 | 9/1992 | Cook et al. | 123/518 |
| 5,189,621 | 2/1993 | Onari et al. | 364/431.04 |
| 5,191,870 | 3/1993 | Cook | 123/520 |
| 5,203,870 | 4/1993 | Kayanuma et al. | 123/198 D |
| 5,299,545 | 4/1994 | Kuroda et al. | 123/520 |

*Primary Examiner*—Kevin J. Teska
*Assistant Examiner*—Dan Fiul
*Attorney, Agent, or Firm*—Nikaido, Marmelstein, Murray & Oram

[57] ABSTRACT

An evaporative fuel-processing system for an internal combustion engine, comprises an evaporative emission control system in which a first control valve is arranged across an evaporative fuel-guiding passage extending between a fuel tank and a canister, a second control valve across a purging passage extending between the canister and the intake system of the engine, and a third control valve at an air inlet port of the canister, respectively. An external diagnostic device is humanly operatable for diagnosing operating conditions of the engine and the vehicle. An ECU is responsive to an output from an external diagnostic device which diagnoses operating conditions of the engine, for determining whether there is an abnormality in the evaporative emission control system, based upon an output from the tank internal pressure sensor, which is obtained when the evaporative emission control system has been brought into the predetermined negatively pressurized state, when the engine is in a predetermined operating condition.

11 Claims, 13 Drawing Sheets

ABNORMALITY DIAGNOSTIC SYSTEM FOR EVAPORATIVE FUEL-PROCESSING SYSTEM OF INTERNAL COMBUSTION ENGINE FOR VEHICLES

BACKGROUND OF THE INVENTION

1. Field of the Invention

This invention relates to an abnormality diagnostic system for an evaporative fuel-processing system for internal combustion engines for vehicles, and more particularly to an abnormality diagnostic system which has a function of detecting abnormalities in an evaporative emission control system of the engine.

2. Prior Art

Conventionally, there has been widely used an evaporative fuel-processing system for internal combustion engines for automotive vehicles, which comprises an evaporative emission control system having a canister having an air inlet port provided therein, a first control valve arranged across an evaporative fuel-guiding passage extending from a fuel tank of the engine to the canister, and a second control valve arranged across a purging passage extending from the canister to an intake system of the engine.

An evaporative emission control system of this kind temporarily stores evaporative fuel in the canister, and then purges the evaporative fuel into the intake system of the engine.

Whether an evaporative emission control system of this kind is normally operating can be checked, for example, by bringing the evaporative emission control system into a predetermined negatively pressurized state, measuring a change in the pressure within the fuel tank (tank internal pressure) occurring with the lapse of time after the evaporating emission control system has been brought into the predetermined negatively pressurized state, by a tank internal pressure sensor which detects the tank internal pressure, and determining whether the system is normally operating, from the measured tank internal pressure, as proposed by Japanese Patent Application No. 3(1991)-262857 and corresponding U.S. Pat. No. 5,299,545, assigned to the assignee of the present application, for example.

According to the method of the earlier application, an amount of change in pressure prevailing within the evaporative emission control system is detected by the tank internal pressure sensor, to determine an abnormality in the system in such a manner that if the detected pressure change amount is below a predetermined value, it is presumed that an amount of evaporative fuel leaking from the system to the outside is small and hence it is determined that the system is normally functioning, whereas if the detected pressure change amount exceeds the predetermined value, it is presumed that evaporative fuel is leaking in a large amount from the system to the outside, and hence it is determined that the system is malfunctioning.

The determination of abnormality of the evaporative emission control system according to the method of the earlier application is carried out when predetermined abnormality determination-permission conditions are satisfied during running of the vehicle, i.e. when the engine enters a predetermined operating condition during running of the vehicle.

However, the upper surface of fuel within the fuel tank largely moves or stirs when the vehicle is in a particular running condition such as acceleration, deceleration and turning. Consequently, the pressure within the fuel tank largely changes when the vehicle is in such a particular running condition. When the pressure within the fuel tank thus largely changes due to running of the vehicle in such a particular running condition, it can be erroneously determined that the system is abnormal even when it is normally functioning.

Further, according to the method of the earlier application, to forcibly bring the interior of the evaporative emission control system into the predetermined negatively pressurized state, the second control valve is opened to communicate the interior of the system with the intake system of the engine via the purging passage. Then, a large amount of fuel vapor (evaporative fuel) is supplied into the intake system due to a gas drawing force created by the engine. This causes large fluctuations in the air-fuel ratio of a mixture supplied to the engine, and more frequent emission of unburnt gases through an exhaust system of the engine.

Moreover, the abnormality determination can be frequently carried out whenever the abnormality determination-permission conditions become satisfied, resulting in spoilage of drivability and degraded exhaust emission characteristics of the engine.

SUMMARY OF THE INVENTION

It is the object of the invention to provide an abnormality diagnostic system for an evaporative fuel-processing system for an internal combustion engine for vehicles, which is capable of accurately detecting abnormalities in an evaporative emission control system of the engine without an erroneous determination, and also capable of carrying out the abnormality determination without spoiling the drivability and exhaust emission characteristics of the engine.

To attain the object, the present invention provides an abnormality diagnostic system for an evaporative fuel-processing system for an internal combustion engine installed in a vehicle and having an intake system, and a fuel tank, the system comprising an evaporative emission control system including a canister having an air inlet port provided therein, an evaporative fuel-guiding passage extending between the fuel tank and the canister, a first control valve arranged across the evaporative fuel-guiding passage, a purging passage extending between the canister and the intake system of the engine, and a second control valve arranged across the purging passage, The abnormality diagnostic system according to the invention is characterized by comprising:

tank internal pressure detecting means for detecting pressure within the fuel tank;

negatively pressurizing means for bringing the evaporative emission control system into a predetermined negatively pressurized state;

external diagnostic means provided externally of the engine, the external diagnostic means being humanly operatable for diagnosing operating conditions of the engine; and abnormality determining means responsive to an output from the external diagnostic means, for determining whether there is an abnormality in the evaporative emission control system based upon an output from the tank internal pressure detecting means, which output is obtained when the evaporative emission control system has been brought into the predetermined negatively pressurized state, when it is determined by the external diagnostic means that the engine is in a predetermined operating condition.

In a preferred form of the invention, the external diagnostic means comprises display means capable of displaying predetermined setting values of a plurality of predetermined operating parameters for setting the predetermined operating condition, and command means for supplying a command signal for carrying out an abnormality diagnosis of the evaporative emission control system, to the abnormality determining means.

Preferably, the abnormality determining means includes operating condition determining means responsive to said command signal from the command means of the external diagnostic means, for determining whether the engine is in the predetermined operating condition.

Alternatively, the external diagnostic means comprises operating condition determining means for determining whether a plurality of predetermined operating parameters satisfy respective predetermined setting values for setting the predetermined operating condition, and command means responsive to an output from the operating condition determining means, for supplying a command signal for carrying out an abnormality diagnosis of the evaporative emission control system, to the abnormality determining means, when it is determined by the operating condition determining means that all the predetermined operating parameters satisfy the respective predetermined setting values.

Preferably, in this alternative arrangement, the display means is capable of displaying at least one of the predetermined operating parameters which does not satisfy a corresponding one of the setting values.

The external diagnostic means includes setting operation means for manually setting values of the predetermined operating parameters such that the predetermined operating condition is established.

More preferably, the abnormality diagnostic system includes vehicle speed detecting means for detecting traveling speed of the vehicle, and wherein the abnormality determining means determines whether there is an abnormality in the evaporative emission control system based upon the output from the tank internal pressure detecting means,when the engine is in a predetermined operating condition, and at the same time it is detected by the vehicle speed detecting means that the vehicle is in a substantially standing condition.

Further, the evaporative fuel-processing system may include engine operation detecting means for detecting whether the engine is operating, and a third control valve for opening and closing the air inlet port of the canister, and wherein the negatively pressurizing means brings the evaporative emission control system into the predetermined negatively pressurized state by controlling the first to third control valves while the engine is detected to be operating. As a result, the evaporative emission control system can be brought into the predetermined negatively pressurized state, merely by controlling the first to third control valves.

Still further, the abnormality determining means determines abnormality of the evaporative emission control system, based upon a rate of change in the pressure within the fuel tank with the lapse of time after the evaporative emission control system has been brought into the predetermined negatively pressurized state by the negatively pressurizing means.

The above and other objects, features, and advantages of the invention will be more apparent from the following detailed description taken in conjunction with the accompanying drawings.

DETAILED DESCRIPTION

The invention will now be described in detail with reference to the drawings showing embodiments thereof.

Figure 1:
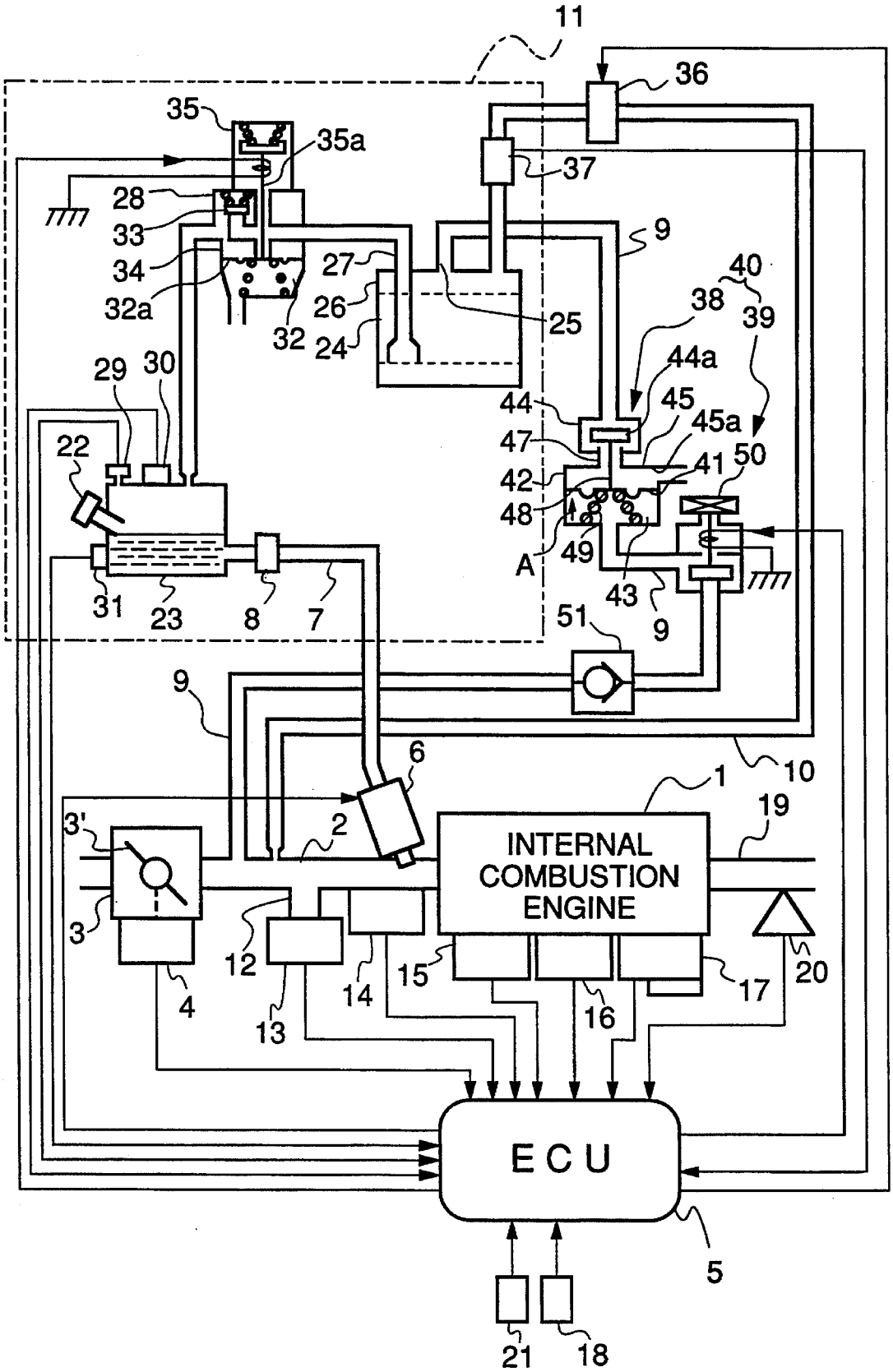
FIG. 1 is a block diagram showing the whole arrangement for an internal combustion engine and an evaporative fuel-processing system therefor, in which is incorporated an abnormality diagnostic system according to an embodiment of the invention.

Referring first to FIG. 1, there is illustrated the whole arrangement of an internal combustion engine installed in an automotive vehicle and an evaporative fuel-processing system therefor, in which is incorporated an abnormality diagnosistic system according to an embodiment of the invention.

In the figure, reference numeral 1 designates an internal combustion engine (hereinafter simply referred to as "the engine") having four cylinders, not shown, for instance. Connected to the cylinder block of the engine 1 is an intake pipe 2 across which is arranged a throttle body 3 accommodating a throttle valve 3' therein. A throttle valve opening (θTH) sensor 4 is connected to the throttle valve 3' for generating an electric signal indicative of the sensed throttle valve opening and supplying same to an electronic control unit (hereinafter referred to as "the ECU") 5.

Fuel injection valves 6, only one of which is shown, are inserted into the interior of the intake pipe 2 at locations intermediate between the cylinder block of the engine 1 and the throttle valve 3' and slightly upstream of respective intake valves, not shown. The fuel injection valves 6 are connected to a fuel pump 8 via a fuel supply pipe 7, and electrically connected to the ECU 5 to have their valve opening periods controlled by signals therefrom.

A negative pressure communication passage 9 and a purging passage 10 open into the intake pipe 2 at respective locations downstream of the throttle valve 3', both of which are connected to an evaporative emission control system 11, referred to hereinafter.

Further, an intake pipe absolute pressure (PBA) sensor 13 is provided in communication with the interior of the intake pipe 2 via a conduit 12 opening into the intake passage 2 at a location downstream of an end of the purging passage 10 opening into the intake pipe 2 for supplying an electric signal indicative of the sensed absolute pressure within the intake pipe 2 to the ECU 5.

An intake air temperature (TA) sensor 14 is inserted into the intake pipe 2 at a location downstream of the conduit 12 for supplying an electric signal indicative of the sensed intake air temperature TA to the ECU 5.

An engine coolant temperature (TW) sensor 15 formed of a thermistor or the like is inserted into a coolant passage filled with a coolant and formed in the cylinder block, for supplying an electric signal indicative of the sensed engine coolant temperature TW to the ECU 5.

An engine rotational speed (NE) sensor 16 is arranged in facing relation to a camshaft or a crankshaft of the engine 1, neither of which is shown. The engine rotational speed sensor 16 generates a pulse as a TDC signal pulse at each of predetermined crank angles whenever the crankshaft rotates through 180 degrees, the pulse being supplied to the ECU 5.

A transmission 17 is connected between wheels of a vehicle, not shown, and an output shaft of the engine 1, for transmitting power from the engine 1 to the wheels.

A vehicle speed (VSP) sensor 18 is mounted on one of the wheels, for supplying an electric signal indicative of the sensed vehicle speed VSP to the ECU 5.

An oxygen concentration ($O_2$) sensor 20 is inserted into an exhaust pipe 19 extending from the engine 1, for supplying an electric signal indicative of the sensed oxygen concentration to the ECU 5.

An ignition switch (IGSW) sensor 21 detects an ON (or closed) state of an ignition switch IGSW, not shown, to detect that the engine 1 is in operation, and supplies an electric signal indicative of the ON state of the ignition switch IGSW to the ECU5.

Electric devices 100 such as an air conditioner is electrically connected to the ECU 5, for supplying electric signals indicative of on-off states thereof to the ECU 5.

A fuel tank 23 having a filler cap 22 which is removed for refueling is provided in the vehicle.

The evaporative emission control system 11 is comprised of a canister 26 containing activated carbon 24 as an adsorbent and having an air inlet port 25 provided in an upper wall thereof, an evaporative fuel-guiding passage 27 connecting between the canister 26 and the fuel tank 23, and a first control valve 28 arranged across the evaporative fuel-guiding passage 27.

The fuel tank 23 is connected to the fuel injection valves 6 via the fuel pump 8 and the fuel supply pipe 7, and has a tank internal pressure (PT) sensor (hereinafter referred to as "the PT sensor") 29 and a fuel amount (FV) sensor 30, both mounted at an upper wall thereof, and a fuel temperature (TF) sensor 31 mounted at a lateral wall thereof. The PT sensor 29, the FV sensor 30, and the TF sensor 31 are electrically connected to the ECU 5. The PT sensor 29 senses the pressure (tank internal pressure) PT within the fuel tank 23 and supplies an electric signal indicative of the sensed tank internal pressure PT to the ECU 5. The FV sensor 30 senses the volumetric amount of fuel within the fuel tank 23 and supplies an electric signal indicative of the sensed volumetric amount of fuel to the ECU 5. The TF sensor 31 senses the temperature of fuel within the fuel tank 23 and supplies an electric signal indicative of the sensed fuel temperature TF to the ECU 5.

The first control valve 28 is comprised of a two-way valve 34 formed of a positive pressure valve 32 and a negative pressure valve 33, and a first electromagnetic valve 35 formed in one body with the two-way valve 34. More specifically, the first electromagnetic valve 35 has a rod **35*a*, a front end of which is fixed to a diaphragm 32*a* of the positive pressure valve 32. Further, the first electromagnetic valve 35 is electrically connected to the ECU 5 to have its operation controlled by a signal supplied from the ECU 5. When the first electromagnetic valve 35 is energized, the positive pressure valve 32 of the two-way valve 34 is forcedly opened to open the first control valve 28, whereas when the first electromagnetic valve 35 is deenergized, the valving (opening/closing) operation of the first control valve 28 is controlled by the two-way valve 34** alone.

A purge control valve (second control valve) 36 is arranged across the purging passage 10 extending from the canister 26, which valve has a solenoid, not shown, electrically connected to the ECU 5. The purge control valve 36 is controlled by a signal supplied from the ECU 5 to linearly change the opening thereof. That is, the ECU 5 supplies a desired amount of control current to the purge control valve 36 to control the opening thereof.

A hot wire-type flowmeter (mass flowmeter) 37 is arranged in the purging passage 10 at a location between the canister 26 and the purge control valve 36. The flowmeter 37 has a platinum wire, not shown, which is heated by an electric current and cooled by a gas flow flowing in the purging passage 10 to have its electrical resistance reduced. The flowmeter 37 has an output characteristic variable in dependence on the concentration and flow rate of evaporative fuel flowing in the purging passage 10 as well as on the flow rate of a mixture of evaporative fuel and air being purged through the purging passage 10. The flowmeter 37 is electrically connected to the ECU 5 for supplying the same with an electric signal indicative of the flow rate of the mixture purged through the purging passage 10.

A drain shut valve 38 is mounted across the negative pressure communication passage 9 connecting between the air inlet port 25 of the canister 26 and the intake pipe 2, and a second electromagnetic valve 39 is mounted across the negative pressure communication passage 9 at a location downstream of the drain shut valve 38, the drain shut valve 38 and the second electromagnetic valve 39 constituting a third control valve 40.

The drain shut valve 38 has an air chamber 42 and a negative pressure chamber 43 defined by a diaphragm 41. Further, the air chamber 42 is formed of a first chamber 44 accommodating a valve element **44*a*, a second chamber 45 formed with an air introducing port 45*a*, and a narrowed communicating passage 47 connecting the second chamber 45 with the first chamber 44. The valve element 44*a* is connected via a rod 48 to the diaphragm 41. The negative pressure chamber 43 communicates with the second electromagnetic valve 39 via the communication passage 9, and has a spring 49 arranged therein for resiliently urging the diaphragm 41 and hence the valve element 44***a* in the direction indicated by an arrow A.

The second electromagnetic valve 39 is constructed such that when a solenoid thereof is deenergized, a valve element thereof is in a seated position to allow air to be introduced into the negative pressure chamber 43 via an air inlet port 50, and when the solenoid is energized, the valve element is in a lifted position in which the negative pressure chamber 43 communicates with the intake pipe 2 via the communication passage 9. In addition, reference numeral 51 indicates a check valve.

The ECU 5 comprises an input circuit having the functions of shaping the waveforms of input signals from various sensors, shifting the voltage levels of sensor output signals to a predetermined level, converting analog signals-from analog-output sensors to digital signals, and so forth, a central processing unit (hereinafter called "the CPU"), memory means storing programs executed by the CPU and for storing results of calculations therefrom, etc., and an output circuit which outputs driving signals to the fuel injection valves 6, the first and second electromagnetic valves 35, 39, and the purge control valve 36.

An external diagnostic device 53 is disconnectibly connected to the ECU 5 by means of a connection cord 52.

Figure 2:
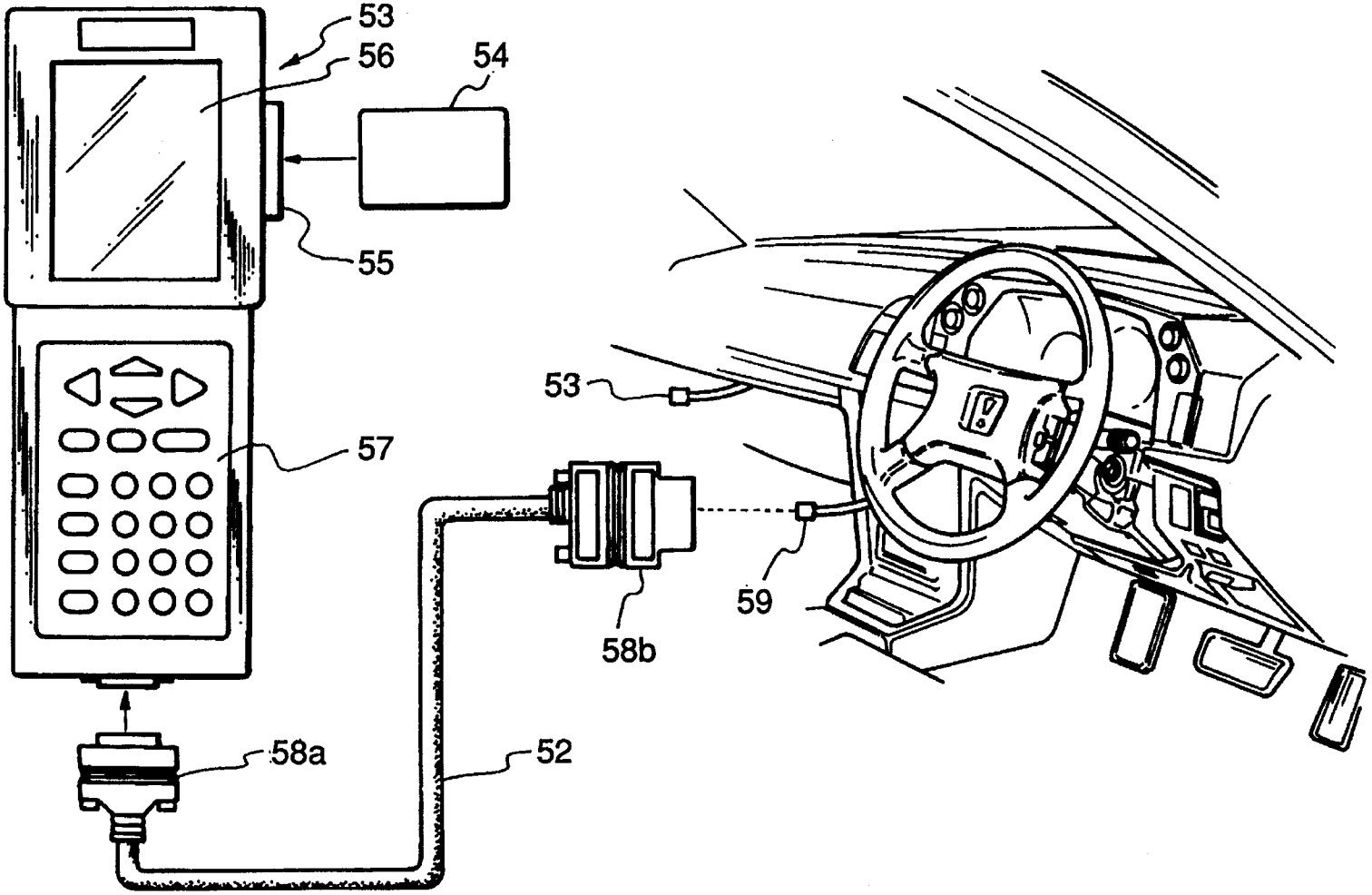
FIG. 2 is a schematic view useful in explaining how to connect an external diagnostic device to a driver's stand of an automotive vehicle.

As shown in detail in FIG. 2, the external diagnostic device 53 is comprised of a display section 56 formed, e.g. by a liquid-crystal display panel and having an insertion opening 55 into which a program card 54 such as a magnetic card, which stores setting data for setting values of a plurality of operating parameters related to operation of the engine, the vehicle, etc. for abnormality diagnoses, and a control section 57 formed of a keyboard, etc. The external diagnostic device 53 is disconnectibly connected to a connector 59 for diagnostic purposes by means of the connection cord 52 with connectors 58*a* and 58*b* secured to ends thereof, to supply command signals for commanding abnormality diagnoses including one for the evaporative emission control system 11. The external diagnostic device 53 is also adapted to supply signals indicative of values of operating parameters of the engine 1 which are inputted via the control section 57. The ECU 5 is responsive to the parameter signals from the external diagnostic device 53 to control the engine 1 into a predetermined operating condition corresponding to the parameter signals in the abnormality diagnostic operation for the evaporative emission control system 11. In FIG. 2, reference numeral 60 designates a service check signal (SCS) terminal. The SCS terminal 60 can be short-circuited to ground by a jumper wire or the like, and then a warning lamp, not shown, of a combination meter, not shown, will be lighted a predetermined number of times to enable to find out an abnormal location within the vehicle including the evaporative emission control system 11 as well as the engine 1 and its related parts. More specifically, several predetermined time numbers are allotted to several predetermined locations within the vehicle, respectively. It is designed that when the SCS terminal is short-circuited, the warning lamp is lighted a predetermined number of times corresponding to the location which is determined to be abnormal, and then the operator will be able to locate the abnormal location.

Next, a manner of determination of abnormality of the evaporative emission control system 11 according to the invention will be described in detail.

Figure 3:
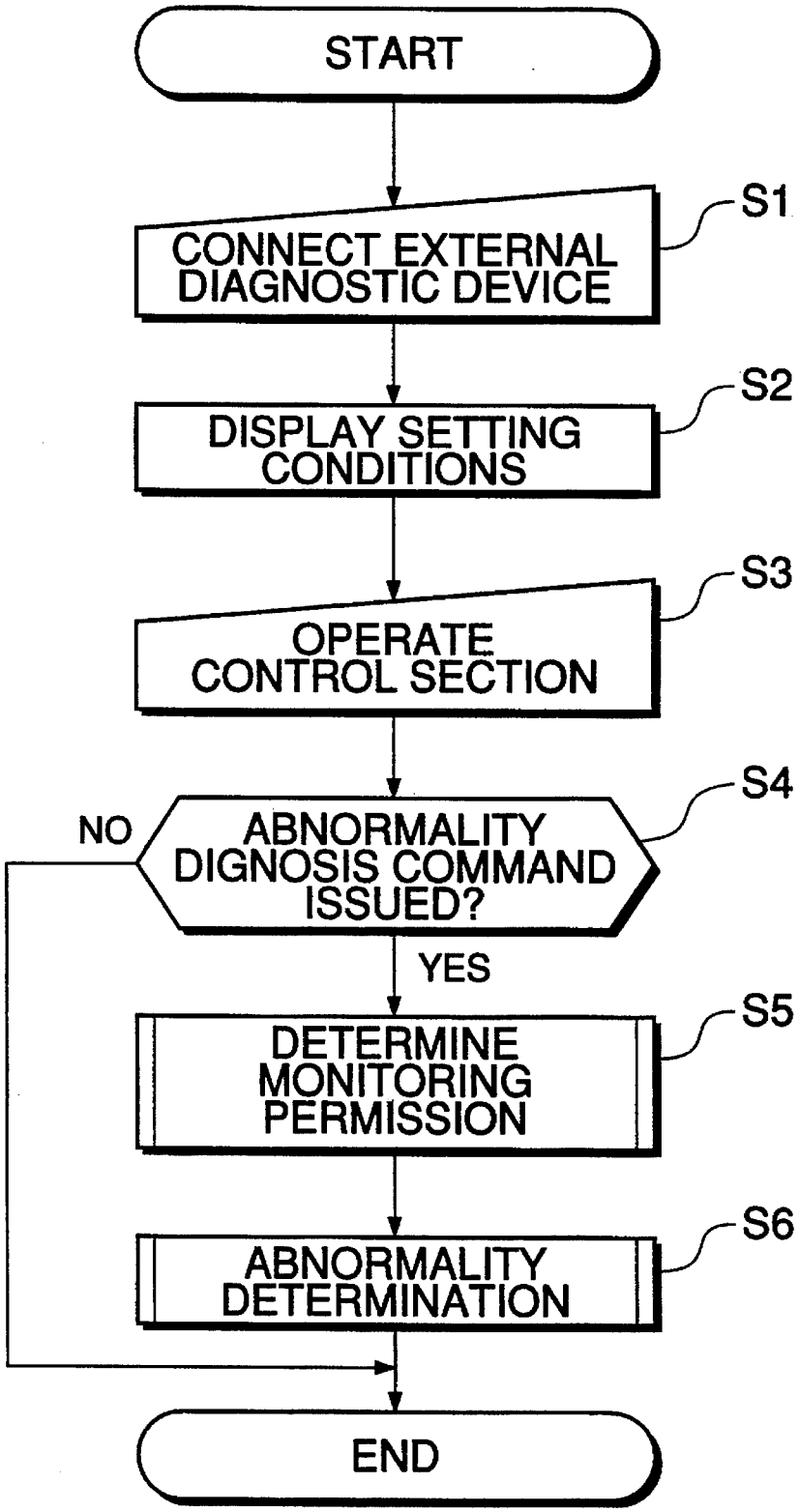
FIG. 3 is a flowchart showing a manner of carrying out an abnormality diagnosis of an evaporative emission control system appearing in FIG. 1, according to a first embodiment of the invention.

FIG. 3 shows a manner of determining an abnormality in the evaporative emission control system 11, according to a first embodiment of the invention.

First, at a step S1, the external diagnostic device 53 is connected to the ECU 5 by the connection cord 52. Then, to carry out the abnormality determination, the program card 54 storing setting data for setting a plurality of predetermined operating parameters for abnormality diagnosis of the system 11 is inserted into the insertion opening 55 of the external diagnostic deice 53, and then setting values of all the predetermined operating parameters are displayed on the display section 56, at a step S2. The predetermined operating parameters include engine coolant temperature TW, vehicle speed VSP, engine rotational speed NE, intake pipe absolute pressure PBA, and loads of the electric devices 100 including the air conditioner, for example, for each of which a predetermined value, range, or state is previously set as a setting condition for enabling the abnormality determination. The predetermined value, range, or state is displayed on the display section 56. Then, the operator carries out a condition-setting operation (e.g. switching over from an off state to an on state of the air conditioner) until all the setting conditions are set, i.e. all the abnormality determination-enabling conditions are satisfied, at a step S3. When all the setting conditions have been set, it is determined at a step S4 whether or not an abnormality diagnosis command signal has been issued from the external diagnostic device 53 to the ECU 5. If the answer to this question is negative (NO), the process is immediately terminated, whereas if the answer is affirmative (YES), the ECU executes a monitoring (abnormality determination)-permission determining routine and then executes an abnormal determination routine, at a step S6, followed by terminating the process.

Figure 4:
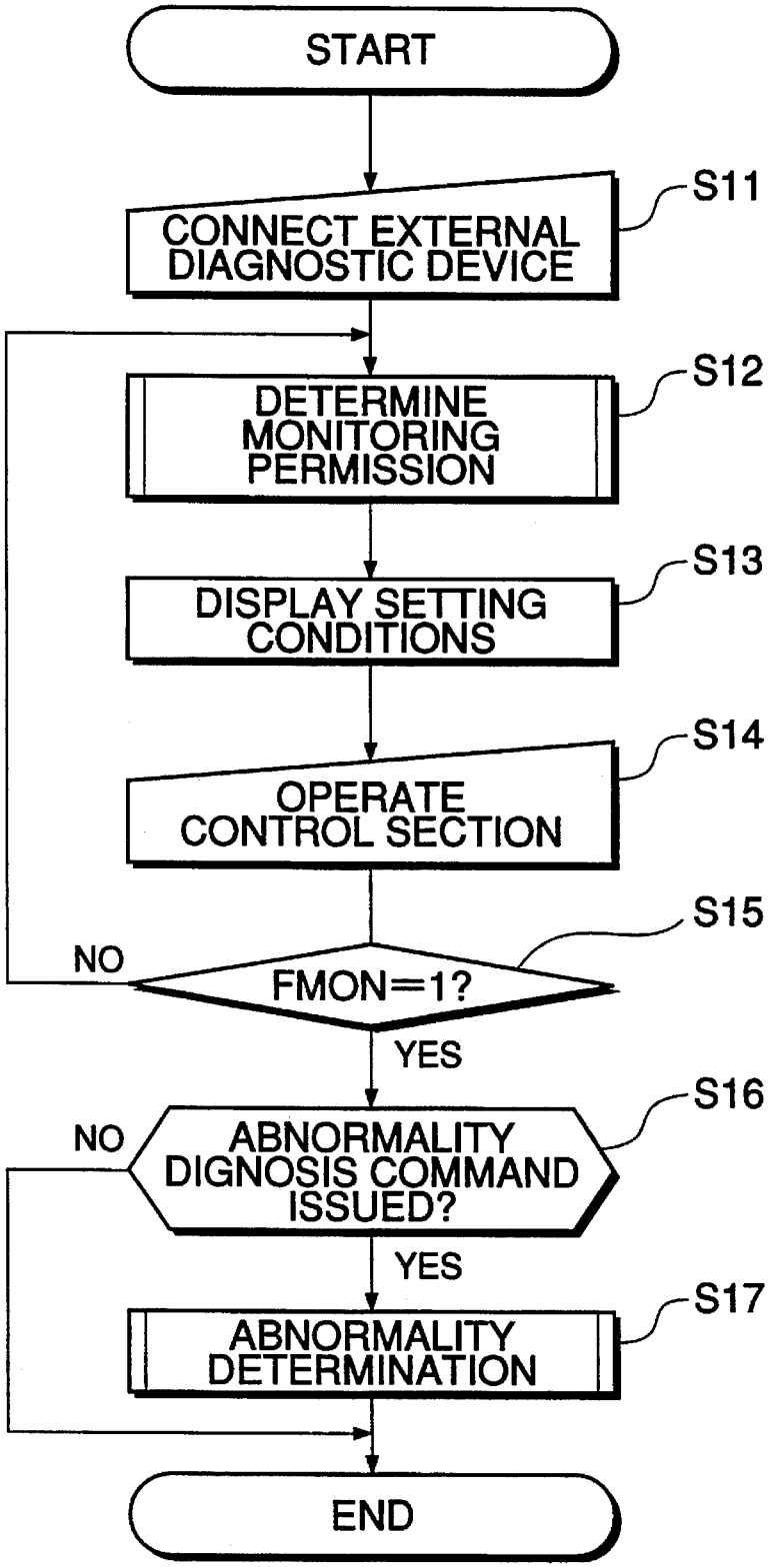
FIG. 4 is a flowchart similar to FIG. 3, according to a second embodiment of the FIG. 5 is a flowchart showing a main routine for determining fulfillment of abnormality determining conditions.

FIG. 4 shows a manner of determining an abnormality in the evaporative emission control system 11, according to a second embodiment of the invention.

First, at a step S11, similarly to the first embodiment, the external diagnostic device 53 is connected to the ECU 5 by the connection cord 52. Then, the external diagnostic device 53 executes the monitoring-permission determining routine based upon information on operating conditions from the ECU 5, at a step S12. If the monitoring is determined not to be permitted, all ones of the above-mentioned predetermined operating parameters, of which ranges, values, or states are not satisfied, are displayed on the display section 56, at a step S13. Then, the operator operates the control section 57 to set the setting conditions corresponding to the predetermined operating parameters which are not satisfied in range, value or state, until the latter are satisfied, at a step S14. Then, at a step S15, it is determined whether or not the monitoring has been permitted, that is, whether or not a flag FMON has been set to "1". If the answer to this question is negative (NO), the program returns to the step S12, whereas if the answer is affirmative (YES), the program proceeds to a step S16, where it is determined whether or not the abnormality diagnosis command signal has been issued from the external diagnostic device 53 to the ECU 5. If the answer to this question is negative (NO), the program is immediately terminated, whereas if the answer is affirmative (YES), the ECU 5 executes the abnormality determination routine at a step S17, followed by terminating the program.

In the above described embodiments, the abnormality determination operation is executed irrespective of whether the SCS terminal 60 is short-circuited. However, the same operation may be executed when the SCS terminal 60 is short-circuited and at the same time the vehicle is under a failure detecting mode, whereby the abnormality determination of the evaporative emission control system 11 can be executed together with abnormality determination of other locations within the vehicle.

Figure 5:
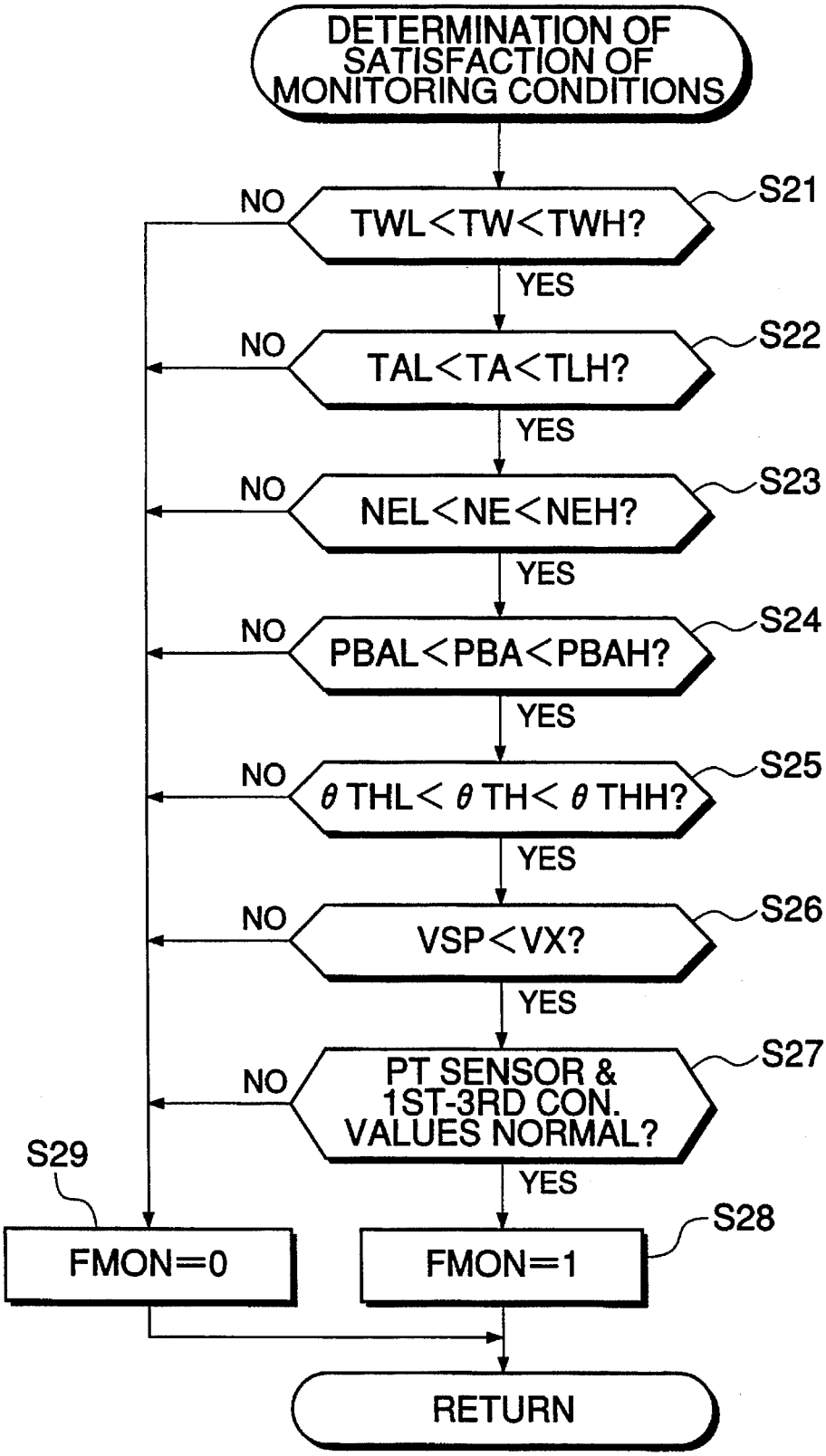

FIG. 5 shows the monitoring (abnormality determination)-permission routine for determining whether or not monitoring of the system 11 for abnormality diagnosis thereof is permitted (the step S5 in FIG. 3 or the step S12 in FIG. 4). This routine is executed as a background processing.

At a step S21, it is determined whether or not the engine coolant temperature TW detected by the TW sensor 15 falls between a predetermined lower limit value TWL (e.g. 50° C.) and a predetermined upper limit value (e.g. 90° C.). If the answer to this question is affirmative (YES), it is determined at a step S22 whether or not the intake air temperature TA detected by the TA sensor 14 falls between a predetermined lower limit value TAL (e.g. 70° C.) and a predetermined higher limit value TAH (e.g. 90° C.). If the answer to this question is affirmative (YES), it is determined that the engine 1 has been warmed up, and then the program proceeds to a step S23.

At the step S23, it is determined whether or not the engine rotational speed NE detected by the NE sensor 16 falls between a predetermined lower limit value NEL (e.g. 2000 rpm) and a predetermined upper limit value NEH (e.g. 4000 rpm). If the answer to this question is affirmative (YES), it is determined at a step S24 whether or not the intake pipe absolute pressure PBA detected by the PBA sensor 13 falls between a predetermined lower limit value PBAL (e.g. a negative value of −350 mmHg) and a predetermined upper limit value PBAH (e.g. a negative value of −150 mmHg). If the answer to this question is affirmative (YES), it is determined at a step S25 whether or not the throttle valve opening θTH detected by the θTH sensor 4 falls between a predetermined lower limit value θTHL (e.g. 1°) and a predetermined upper limit value θTHH (e.g. 5°). If the answer to this question is affirmative (YES), it is determined at a step S26 whether or not the vehicle speed VSP detected by the VSP sensor 21 is lower than a predetermined low value VX (e.g. 2 km/hr). If the answer to this question is affirmative (YES), it is determined that the vehicle is substantially stationary or standing, and then the program proceeds to a step S27. At the step S27, it is determined whether or not the PT sensor 29, and the first to third control valves 28, 36, and 39 are normally operating. If the answer to this question is affirmative (YES), the flag FMON is set to "1" at a step S28 for permitting monitoring of the system 11 for abnormality diagnosis, followed by terminating the program. On the other hand, if at least one of the answers to the questions of the steps S21 to S27 is negative (NO), the conditions for permitting monitoring are not satisfied, so that the flag FMON is set to "0" at a step S29, followed by terminating the program.

Next, the manner of the abnormality determination carried out at the step S6 in FIG. 3 or at the step S16 in FIG. 4 will be described in detail with reference to FIG. 6.

Figures 6A, 6B, 6C, 6D, 6E:
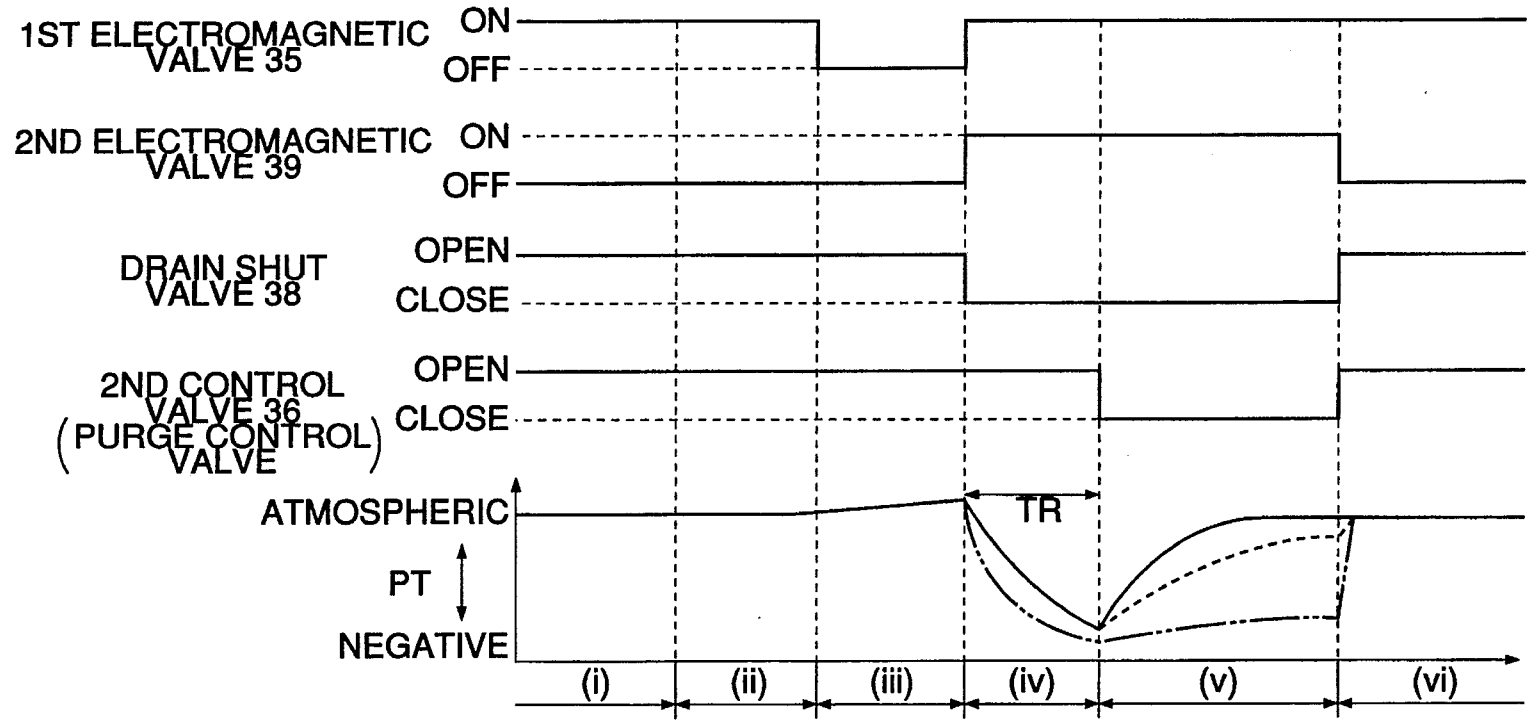
FIG. 6 is a timing chart showing operating patterns of first and second electromagnetic valves and a drain shut valve, all appearing in FIG. 1.

FIG. 6 shows patterns of operations of the first and second electromagnetic valves 35, 39 and the drain shut valve 38 and the purge control valve 36 performed during an diagnosis of abnormality of the evaporative emission control system 11, and changes in the tank internal pressure PT occurring during the diagnosis. The operations of these valves are commanded by control signals from the ECU 5.

First, during normal operation (normal purging) of the engine, as indicated by (i) in FIG. 6, the first electromagnetic valve 35 is energized and at the same time the second magnetic valve 32 is deenergized. When the ignition switch IGSW is closed and the engine is detected to be operating, by the IGSW sensor 18, the purge control valve 36 is energized to be opened. Then, evaporative fuel generated within the fuel tank 23 is allowed to flow through the evaporative fuel-guiding passage 27 into the canister 26 to be temporarily adsorbed by the adsorbent 24. Since the second electromagnetic valve 39 is deenergized as mentioned above, the drain shut valve 38 is open to allow fresh air to be introduced into the canister 26 through the air inlet port **45*a* so that evaporative fuel flowing into and stored in the canister 26 is purged together with fresh air through the second control valve 36 into the purging passage 10. On this occasion, if the fuel tank 23 is cooled due to ambient air, etc., negative pressure is developed within the fuel tank 23, which causes the negative pressure valve 33 of the two-way valve 34 to be opened so that part of the evaporative fuel in the canister 26 is returned through the two-way valve 34 into the fuel tank 23**.

When the predetermined monitoring (abnormality determination)-permission conditions, described before with reference to FIG. 5, are satisfied, the first and second electromagnetic valves 35, 39, and the purge control valve 36 are operated in the following manner to carry out an abnormality diagnosis of the evaporative emission control system 11.

First, the tank internal pressure PT is relieved to the atmosphere, over a time period indicated by (ii) in FIG. 6. More specifically, the first electromagnetic valve 35 is held in the energized state to maintain communication between the fuel tank 23 and the canister 26, and at the same time the second electromagnetic valve 39 is held in the deenergized state to keep the drain shut valve 38 open. Further, the purge control valve 36 is held in the energized state or opened, to relieve the tank internal pressure PT to the atmosphere.

Then, an amount of change in the tank internal pressure PT is measured over a time period indicated by (iii) in FIG. 6.

More specifically, the second electromagnetic valve 39 is held in the deenergized state to keep the drain shut valve 38 open, and at the same time the purge control valve 36 is kept open. However, the first electromagnetic valve 35 is turned off into the deenergized state, to thereby measure an amount of change in the tank internal pressure PT occurring after the fuel tank 23 has ceased to be open to the atmosphere for the purpose of checking an amount of evaporative fuel generated in the fuel tank 23.

Then, the evaporative emission control system 11 is negatively pressurized over a time period TR indicated by (iv) in FIG. 6. More specifically, the first electromagnetic valve 35 and the purge control valve 36 are held in the energized state, while the second electromagnetic valve 39 is turned on to close the drain shut valve 38, whereby the evaporative emission control system 11 is negatively pressurized by a gas drawing force developed by negative pressure in the purging passage 10 held in communication with the intake pipe 2.

Then, a leak down check is carried out over a time period indicated by (v) in FIG. 6.

More specifically, after the evaporative emission control system 11 is negatively pressurized to a predetermined degree, i.e. after the predetermined negatively-pressurized state of the system is established, the purge control valve 36 is closed, and then a change in the tank internal pressure PT occurring with the lapse of time thereafter is checked by the PT sensor 29. If the system 11 does not suffer from a significant leak of evaporative fuel therefrom, and hence the result of the leak down check shows that there is no substantial change in the tank internal pressure PT as indicated by the two-dot-chain line in the figure, it is determined that the evaporative emission control system 11 is normal, whereas if the system 11 suffers from a significant leak of evaporative fuel therefrom, and hence the result of the leak down check shows that there is a significant change in the tank internal pressure PT toward the atmospheric pressure, as indicated by the solid line, it is determined that the system 11 is abnormal. In this connection, if the evaporative emission control system 11 cannot be brought into the predetermined negatively pressurized state within a predetermined time period, the leak down check is inhibited, as hereinafter described.

After determining whether or not the system 11 is abnormal, the system 11 returns to the normal purging mode, as indicated by (vi) in FIG. 6.

More specifically, while the first electromagnetic valve 35 is held in the energized state, the second electromagnetic valve 39 is deenergized and the purge control valve 36 is opened, to thereby perform normal purging of evaporative fuel. In this state, the tank internal pressure PT is relieved to the atmosphere and hence becomes substantially equal to the atmospheric pressure.

Next, the manner of abnormality diagnosis of the evaporative emission control system 11 will be described.

Figure 7:
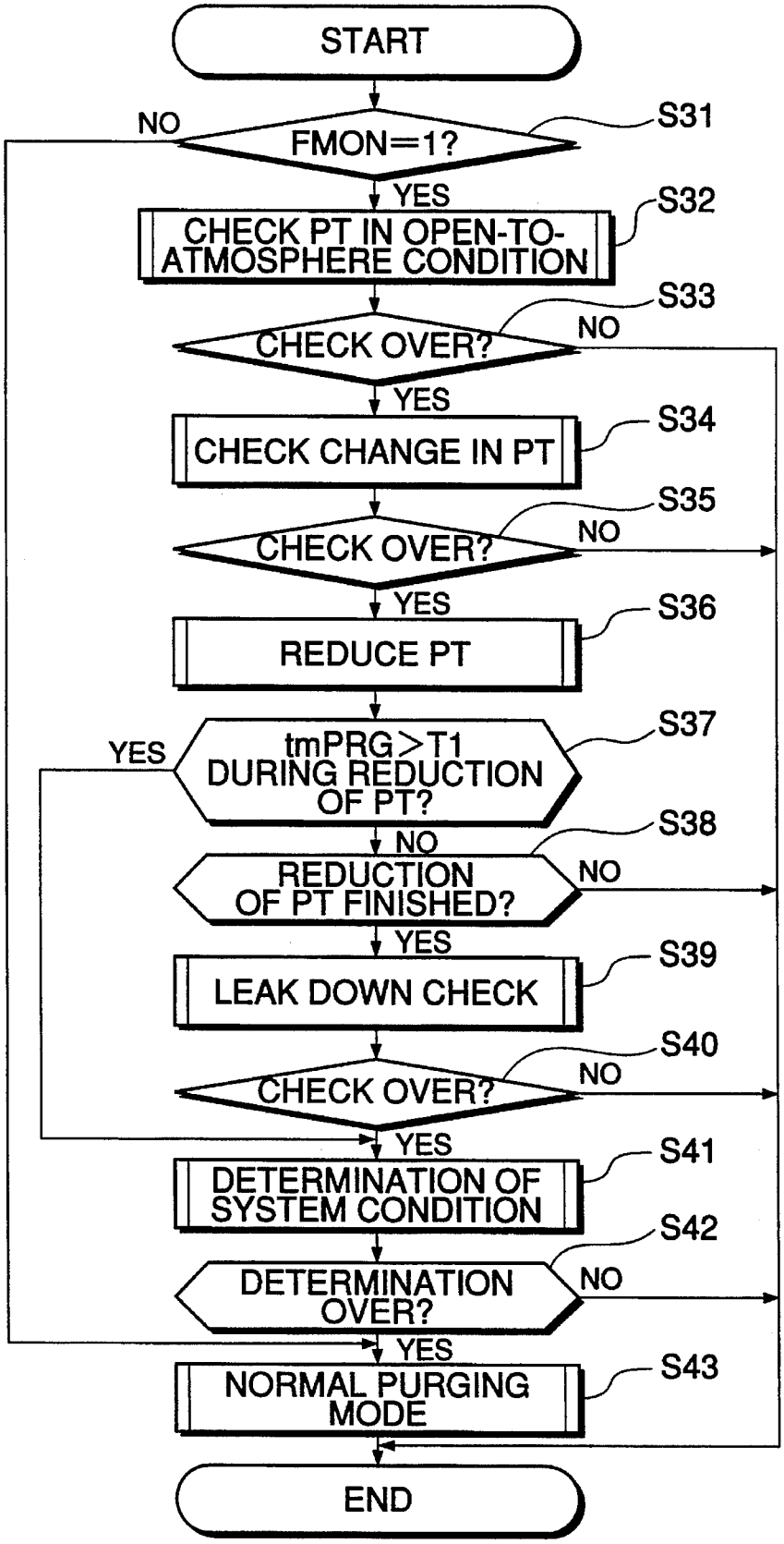
FIG. 7 is a flowchart showing a routine for determining an abnormality in the evaporative emission control system.

FIG. 7 shows a program for carrying out the abnormality diagnosis of the evaporative emission control system 11, which is executed by the CPU of the ECU 5.

First, at a step S31, it is determined whether or not the monitoring (abnormality determination) is permitted, i.e. the flag FMON has been set to "1". If the answer to this question is negative (NO), the first to third control valves 28, 36, 40 are set to respective operative states for normal purging mode of the system as mentioned before, followed by terminating the program, whereas if the answer to this question is affirmative (YES), the tank internal pressure PT in the open-to-atmosphere condition of the system is checked at a step S32, and it is determined at a step S33 whether or not this check has been completed. If the answer to this question is negative (NO), the program is immediately terminated, whereas if it is affirmative (YES), the first electromagnetic valve 35 is turned off to check a change in the tank internal pressure PT at a step S34, followed by determining at a step S35 whether or not this check has been completed. If the answer to this question is negative (NO), the program is immediately terminated, whereas if it is affirmative (YES), the first to third control valves 28, 36, 40 are operated at a step S36 to bring about the negatively pressurized state of the evaporative emission control system 11 and the fuel tank 23.

Simultaneously with the start of the negative pressurization at the step S36, a first timer tmPRG incorporated in the ECU 5 is started, and it is determined at a step S37 whether or not the count value thereof is larger than a value corresponding to a predetermined time period T1. The predetermined time period T1 is set to such a value as ensures that the system 11 is negatively pressurized to a predetermined pressure value, i.e. the negatively pressurized state of the system 11 is established within the predetermined time period T1, if the system is normal. If the answer to the question of the step S37 is affirmative (YES), it is determined that the system 11 cannot be negatively pressurized to the predetermined pressure value due to a hole formed in the fuel tank 23, etc., the program proceeds to a step S41. On the other hand, if the answer to the question of the step S37 is negative (NO), it is determined at a step S38 whether or not the negative pressurization has been completed, i.e. the negatively pressurized state of the system 11 is established. If the answer to this question is negative (NO), the program is immediately terminated, whereas if it is affirmative (YES), a leak down check routine, described in detail hereinafter, is carried out at a step S39 to check whether or not the system 11 is properly sealed, i.e. it is free from a leak of evaporative fuel therefrom in the normal operating mode thereof. Then, at a step S40, it is determined whether or not this check has been completed.

If the answer to this question is negative (NO), the program is immediately terminated, whereas if the answer is affirmative (YES), the program proceeds to the step S41.

At the step S41, a determination is made as to whether or not the system 11 is in a normal condition, followed by determining at a step S42 whether the determination of the step S41 has been completed. If the answer to this question is negative (NO), the program is immediately terminated, whereas if it is affirmative (YES), the system 11 is set to the normal purging mode at a step S43, followed by terminating the program.

Next, the above steps will be described in detail hereinbelow:

(1) Check of Tank Internal Pressure in Open-to-Atmosphere Condition (at the step S32 in FIG. 7)

Figure 8:
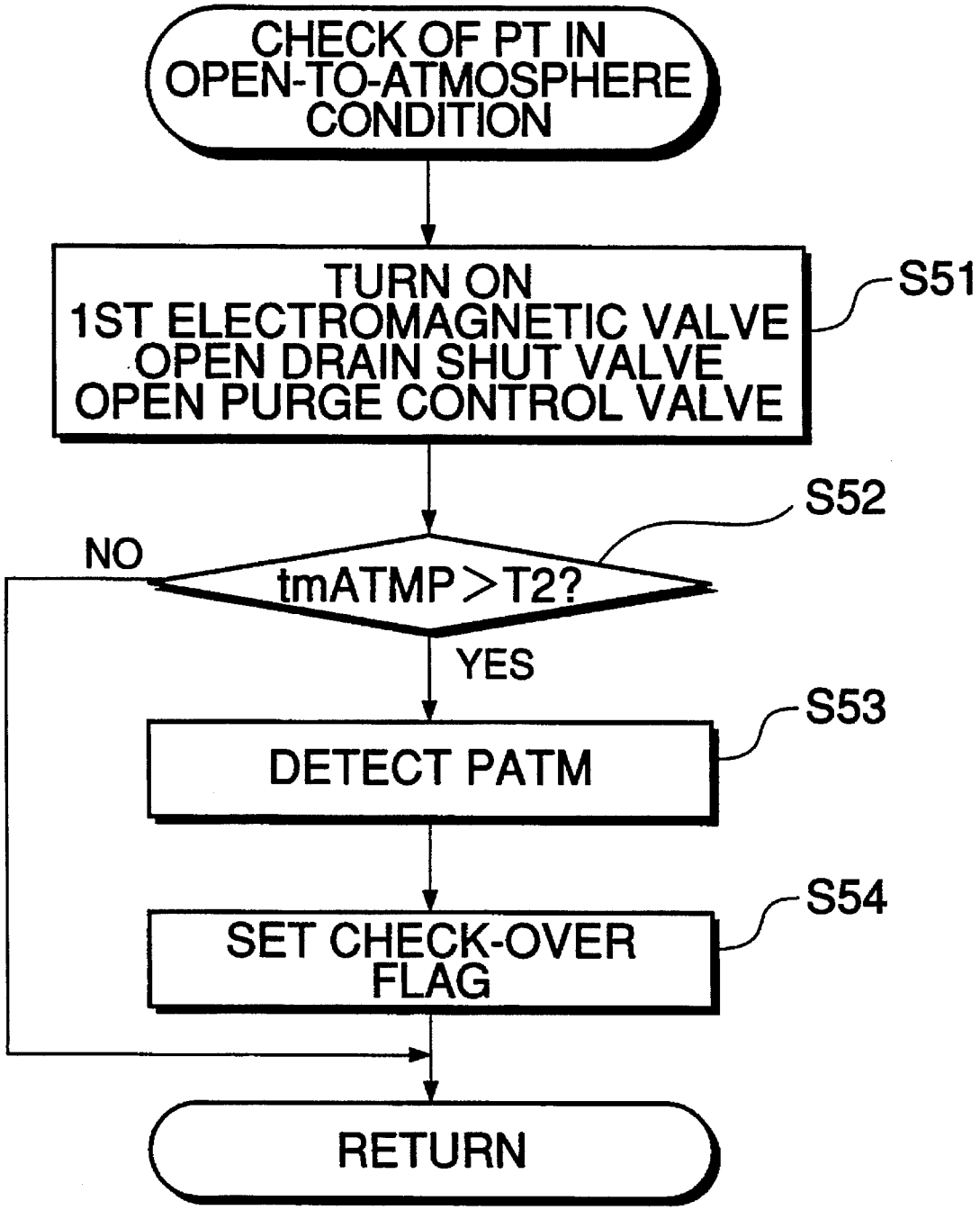
FIG. 8 is a flowchart showing a routine for checking pressure within a fuel tank in FIG. 1 (tank internal pressure) when the interior of the fuel tank is open to the atmosphere.

FIG. 8 shows a routine for carrying out the tank internal pressure check in the open-to-atmosphere condition, which is executed as a background processing.

First, at a step S51, the system 11 is set to the open-to-atmosphere mode, and at the same time, a second timer tmATMP is reset and started. More specifically, the first electromagnetic valve 35 is held in the energized state, and at the same time the second electromagnetic valve 39 is held in the deenergized state to keep the drain shut valve 38 open. Further, the purge control valve 36 is kept open. Thus, the tank internal pressure PT is relieved to the atmosphere (see the time period indicated by (ii) in FIG. 6).

Then, at a step S52, it is determined whether or not the count value of the second timer tmATMP is larger than a value corresponding to a predetermined time period T2. The predetermined time period T2 is set to a predetermined value, e.g. 4 sec, which ensures that the pressure within the system 11 has been stabilized upon lapse thereof. If the answer to this question is negative (NO), the program is immediately terminated, while if it is affirmative (YES), the program proceeds to a step S53, where the tank internal pressure PATM in the open-to-atmosphere condition is detected by the PT sensor 29 and stored into the ECU 5, and then a check-over flag is set at a step S54, followed by terminating the program.

(2) Check of A Change in Tank Internal Pressure (at the step S34 in FIG. 7)

Figure 9:
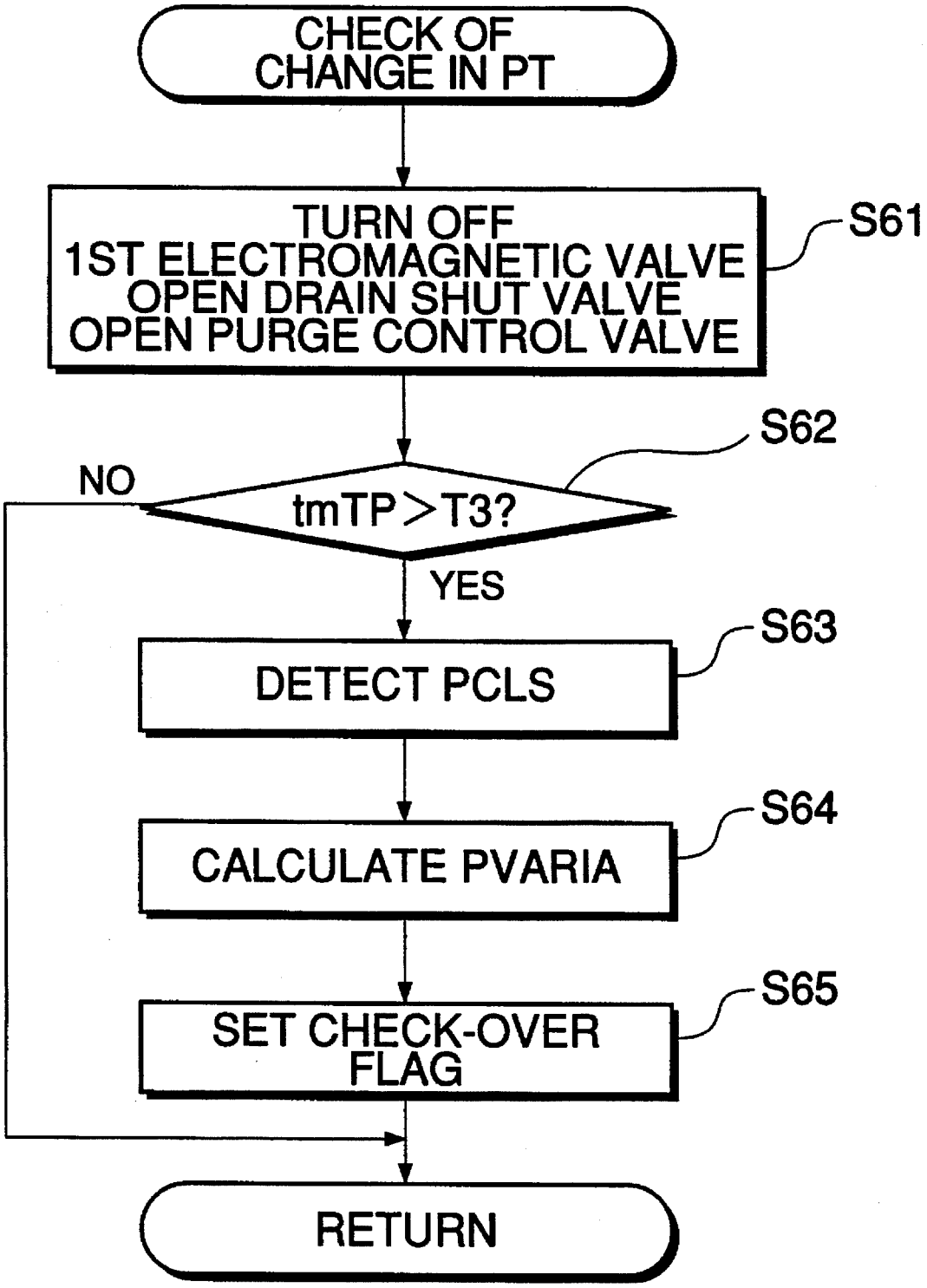
FIG. 9 is a flowchart showing a routine for checking changes in the tank internal pressure when the interior of the evaporative emission control system is made open to the atmosphere.

FIG. 9 shows a routine for checking a change in the tank internal pressure, which is executed as a background processing.

First, at a step S61, the system 11 is set to a PT change-checking mode, and at the same time a third timer tmTP is reset and started. More specifically, while the purge control valve 36 and the drain shut valve 38 are held open, the first electromagnetic valve 35 is turned off to thereby set the system to the PT change checking mode (see the time period indicated by (iii) in FIG. 6).

Then, at a step S62, it is determined whether or not the count value of the third timer tmTP is larger than a value corresponding to a third predetermined time period T3, e.g. 10 sec. If the answer to this question is negative (NO), the program is immediately terminated, whereas if it is affirmative (YES), the tank internal pressure PCLS after the lapse of the predetermined time period T3 is detected and stored into the ECU 5 at a step S63, followed by calculation of a first rate of change PVARIA in the tank internal pressure at a step S64 by the use of the following equation (1):

$$PVARIA=(PCLS-PATM)/T3 \quad (1)$$

Then, the first rate of change PVARIA thus calculated is stored into the ECU 5 and a check-over flag is set at a step S65, followed by terminating the program.

(3) Negative Pressurization (at the step S36 in FIG. 7)

Figure 10:
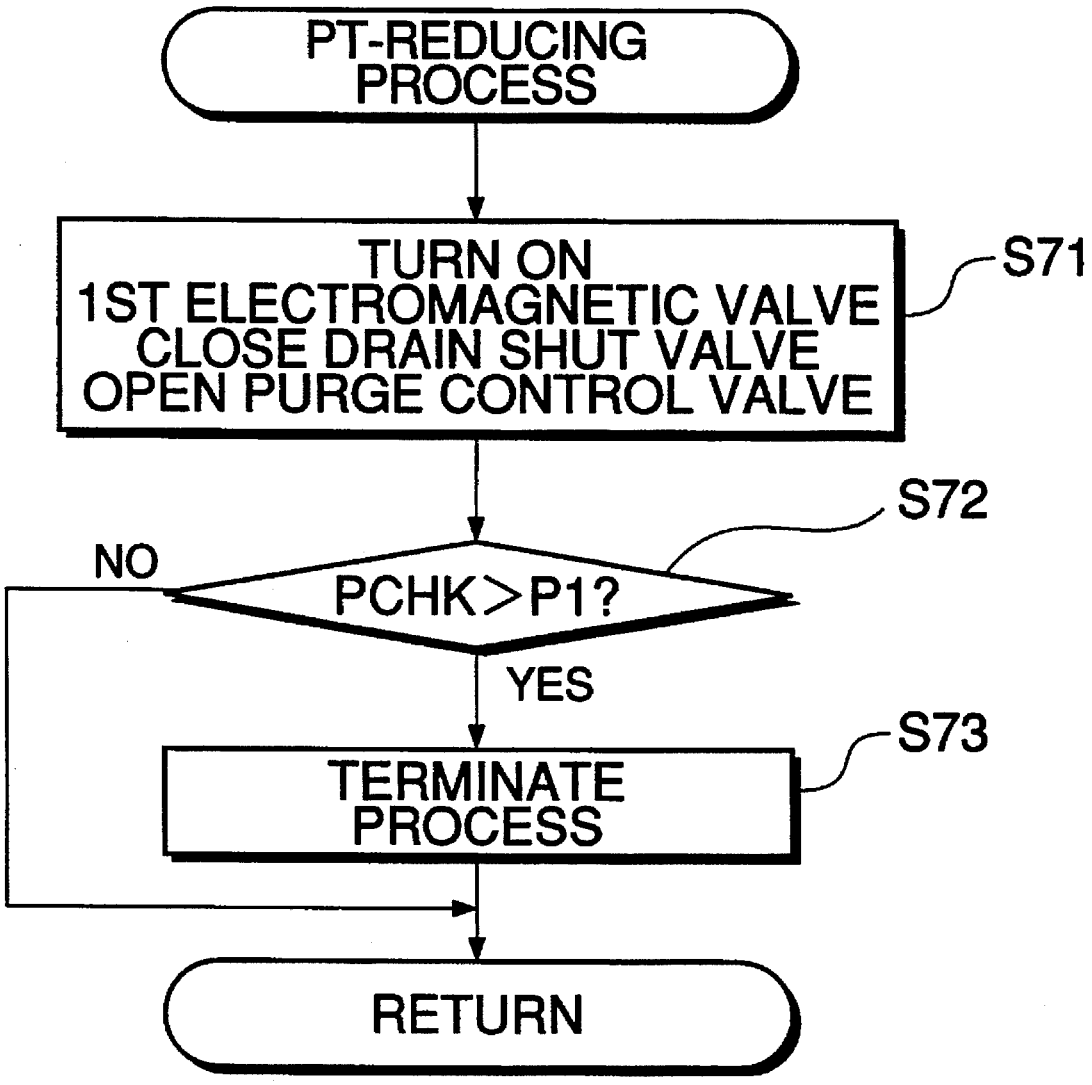
FIG. 10 is a flowchart showing a routine for reducing the tank internal pressure.

FIG. 10 shows a routine for carrying out a process of negatively pressurizing the system 11 to bring about the negatively pressurized state of the system, which is executed as a background processing.

First, at a step S71, the system 11 is set to a negatively pressurizing mode. More specifically, the purge control valve 36 is kept open, and at the same time the first electromagnetic valve 35 is turned on, and the second electromagnetic valve 39 is turned on to close the drain shut valve 38 (see the time period indicated by (iv) in FIG. 6). In this state, the system 11 is negatively pressurized to a predetermined value by a gas-drawing force created by operation of the engine 1. Then, it is determined at a step S72 whether or not the tank internal pressure PCHK in this mode of the system 11 is lower than a predetermined value P1 (e.g. −20 mmHg). If the answer to this question is negative (NO), the program is immediately terminated, whereas if it becomes affirmative (YES), a process-over flag is set at a step S73, followed by terminating the program.

(4) Leak Down Check (at the step S39 in FIG. 7)

Figure 11:
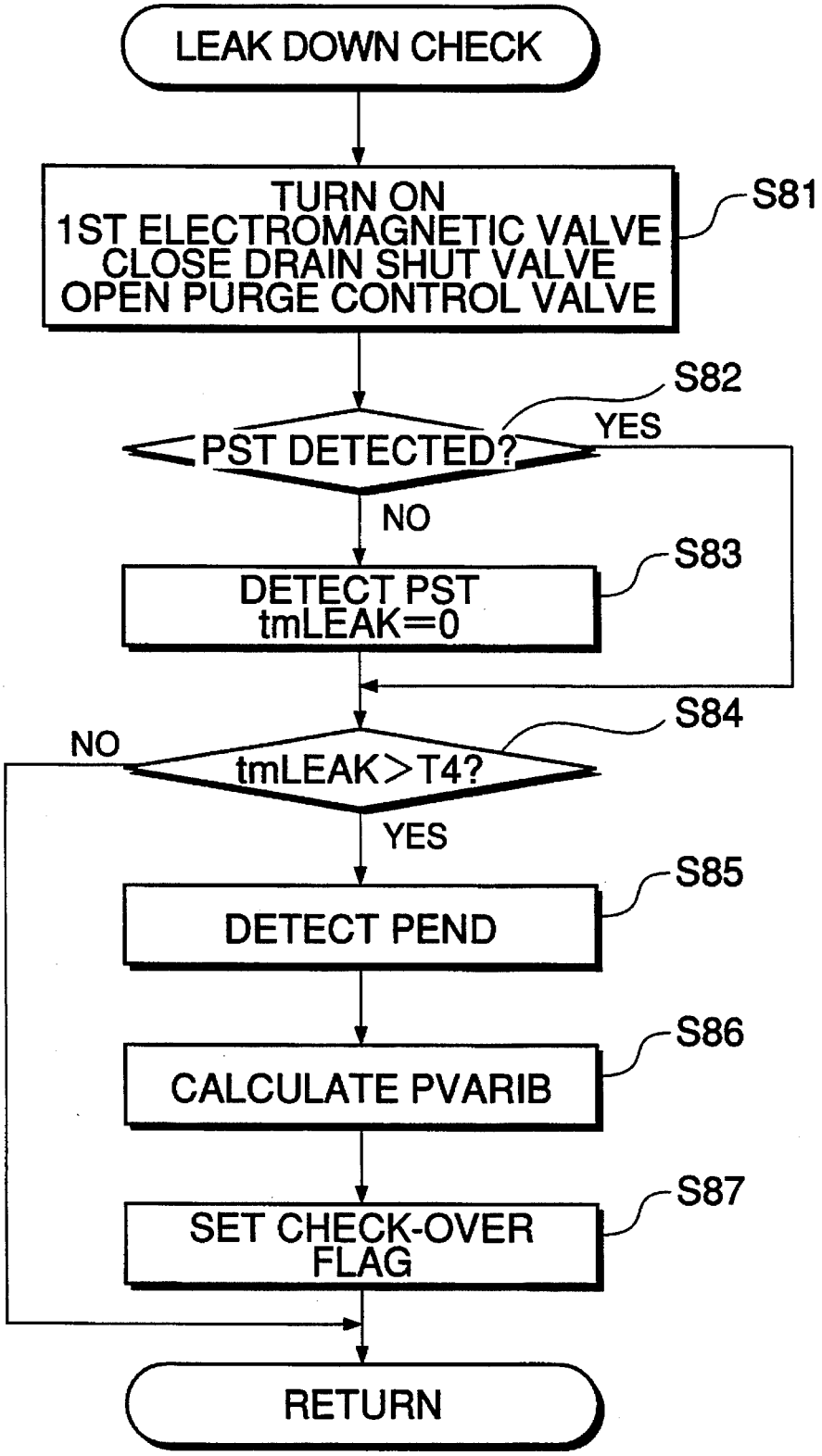
FIG. 11 is a flowchart showing a leak down check routine for checking a change rate in the tank internal pressure when the evaporative emission control system is isolated from the intake pipe.

FIG. 11 shows a routine for performing a leak down check of the system 11, which is executed as a background processing.

First, at a step S81, the system 11 is set to a leak down check mode. More specifically, while the first electromagnetic valve 35 is held in the energized state, and at the same time the drain shut valve 38 is kept closed, the purge control valve 36 is closed to cut off the communication between the system 11 and the intake pipe 2 of the engine 1 (see the time period (v) in FIG. 6).

Then, the program proceeds to a step S82, wherein it is determined whether or not the tank internal pressure PST at the start of the leak down check has been detected. In the first execution of this step S82, the answer to this question is negative (NO), so that the program proceeds to a step S83, wherein the tank internal pressure PST is detected and a fourth timer tmLEAK is reset and started.

Then, it is determined at a step S84 whether or not the count value of the fourth timer tmLEAK is larger than a value corresponding to a fourth predetermined time period T4 (e.g. 10 sec). In the first execution of this step S84, the answer to this question is negative (NO), so that the program is immediately terminated.

In the following loop, the answer to the question of the step S82 becomes affirmative (YES), so that the program jumps over to the step S84, wherein it is determined whether or not the count value of the fourth timer tmLEAK is larger than the value corresponding to the predetermined time period T4. If the answer to this question is negative (NO), the program is immediately terminated, whereas if it becomes affirmative (YES), the present tank internal pressure, i.e. the tank internal pressure PEND at the end of the leak down check is detected and stored into the memory means of the ECU 5 at a step S85, followed by calculation of a second rate of change PVARIB in the tank internal pressure PT at a step S86 by the use of the following equation (2):

$$PVARIB=(PEND-PST)/T4 \quad (2)$$

The second rate of change PVARIB in the tank internal pressure PT thus calculated is stored into the memory means of the ECU 5, and a check-over flag is set at a step S87, followed by terminating the program.

(5) System Condition-Determining Process (at the step S41 in FIG. 7)

Figure 12:
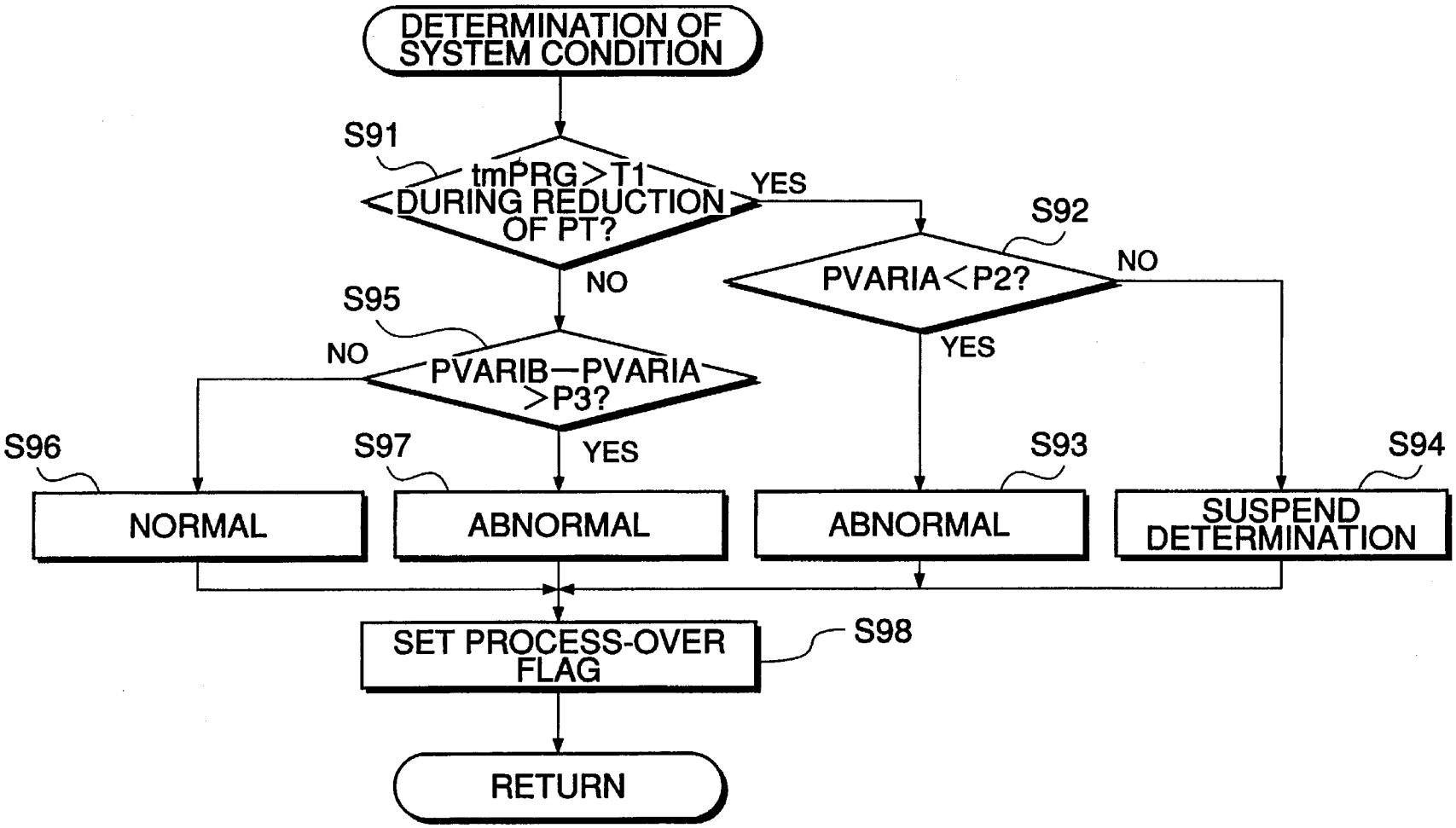
FIG. 12 is a flowchart showing a routine for determining a condition of the evaporative emission control system.

FIG. 12 shows a routine for carrying out a process of determining a condition of the system 11, which is executed as a background processing.

First, at a step S91, it is determined whether or not the count value of the first timer tmPRG exceeded the value corresponding to the predetermined value T1 during the negatively-pressurizing process. If the answer to this question is affirmative (YES), it is determined that the system 11 may suffer from a significant leak of evaporative fuel due to a hole formed in the fuel tank 23, etc., so that the program proceeds to a step S92, where it is determined whether or not the first rate of change PVARIA in the tank internal pressure PT is smaller than a predetermined value P2. If the answer to this question is affirmative (YES), which means that evaporative fuel was not generated in a large amount in the fuel tank 23 so that the rate of rise in the tank internal pressure PT was low during the check of a change in the tank internal pressure PT at (iii) in FIG. 6, it is determined that the system 11 suffers from a significant leak of evaporative fuel from the fuel tank 23, piping connections, etc., determining that the evaporative emission control system 11 is abnormal (step S93), and then a process-over flag is set at a step S98, followed by terminating the program. On the other hand, if the answer to the question of the step S92 is negative (NO), which means that evaporative fuel was generated in a large amount in the fuel tank 23 to increase the tank internal pressure PT, which prevented the system 11 from being negatively pressurized in a proper manner in the negatively-pressurizing process, the determination of the system condition is suspended at a step S94, and then the process-over flag is set at the step S98, followed by terminating the program.

Figure 13:
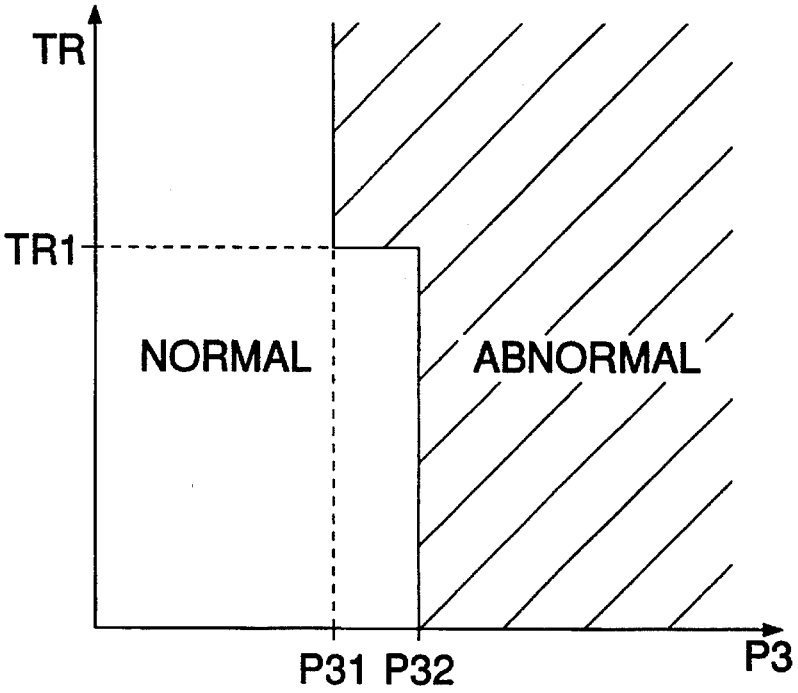
FIG. 13 shows a map used for the abnormality determination.

On the other hand, if the answer to the question of the step S91 is negative (NO), i.e. if the system 11 was negatively pressurized to the predetermined value within the predetermined time period tmPRG, an abnormality-determining routine is carried out at a step S95, wherein it is determined whether or not the difference between the second rate of change PVARIB and the first rate of change PVARIA is larger than a predetermined value P3, in order to determine whether the value of the second rate of change PVARIB is due to a leak from the evaporative emission control system 11 or due to the amount of evaporative fuel generated within the fuel tank 23. The predetermined value P3 is set depending upon the negatively pressuring time period TR as shown in FIG. 13. More specifically, it is set to a value P31 when the time period TR is longer than a predetermined value TR1, while it is set to a value P32 (>P31) when the former is shorter than the latter. If the answer to the question of the step S95 is negative (NO), it is determined that the system 11 is normal, followed by terminating the program, whereas if the answer is affirmative (YES), it is determined at a step S97 that the second rate of change PVARIB assumes a large value because there has been occurring a large leak amount from the system 11, and hence it is determined that the system 11 is abnormal, followed by terminating amount.

(7) Normal Purging (at the step S43 in FIG. 7)

Figure 14:
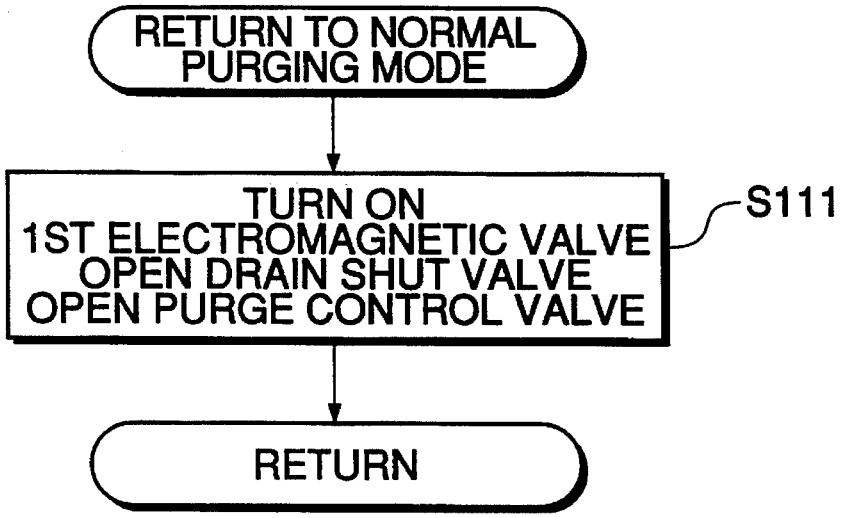
FIG. 14 is a flowchart showing a routine for carrying out normal purging.

FIG. 14 shows a routine for restoring the normal purging mode of the system 11, in which the operative states of the valves are specified.

More specifically, the first electromagnetic valve 35 is held in the energized state and the drain shut valve 39 and the purge control valve 36 are opened to thereby set the system to the normal purging mode, at a step S111, followed by terminating the program.

What is claimed is:

1. In an abnormality diagnostic system for an evaporative fuel-processing system for an internal combustion engine installed in a vehicle and having an intake system, and a fuel tank, the system comprising an evaporative emission-control system including a canister having an air inlet port provided therein, an evaporative fuel-guiding passage extending between said fuel tank and said canister, a purging passage extending between said canister and said intake system of said engine, and a first control valve arranged across said purging passage, the improvement comprising:

pressure detecting means for detecting pressure within said evaporative emission control system;

negatively pressurizing means for bringing said evaporative emission control system into a predetermined negatively pressurized state;

external diagnostic means provided externally of said engine, said external diagnostic means being humanly operable for diagnosing operating conditions of said engine, said external diagnostic means for generating a command signal for carrying out an abnormality diagnosis of said evaporative emission control system when said engine is in a predetermined operating condition suitable for said abnormality diagnosis of said evaporative emission control system; and abnormality determining means responsive to said command signal from said external diagnostic means, for determining whether there is an abnormality in said evaporative emission control system based upon an output from said pressure detecting means, which output is obtained when said evaporative emission control system has been brought into said predetermined negatively pressurized state, when said engine is in said predetermined operation condition.

2. An abnormality diagnostic system as claimed in claim 1, wherein said external diagnostic means comprises display means capable of displaying predetermined setting values of a plurality of predetermined operating parameters for setting said predetermined operating condition, and command means for supplying said command signal for carrying out said abnormality diagnosis of said evaporative emission control system, to said abnormality determining means.

3. An abnormality diagnostic system as claimed in claim 2, wherein said abnormality determining means includes operating condition determining means responsive to said command signal from said command means of said external diagnostic means, for determining whether said engine is in said predetermined operating condition.

4. An abnormality diagnostic system as claimed in claim 1, wherein said external diagnostic means comprises operating condition determining means for determining whether a plurality of predetermined operating parameters for setting said predetermined operating conditions assume respective predetermined setting values for setting said predetermined operating conditions, and command means responsive to an output from said operating condition determining means, for supplying said command signal for carrying out said abnormality diagnosis of said evaporative emission control system, to said abnormality determining means, when it is determined by said operating condition determining means that all said predetermined operating parameters assume said respective predetermined setting values.

5. An abnormality diagnostic system as claimed in claim 4, wherein said external diagnostic means includes display means capable of displaying predetermined setting values of said predetermined operating parameters for setting said predetermined operating conditions, said display means being capable of displaying at least one of said predetermined operating parameters which does not assume a corresponding one of said setting values.

6. An abnormality diagnostic system as claimed in any one of claims 2, 3, 4 or 5, wherein said external diagnostic means includes setting operation means for manually setting values of said predetermined operating parameters such that said predetermined operating condition is established.

7. An abnormality diagnostic system as claimed in claim 1, including vehicle speed detecting means for detecting traveling speed of said vehicle, and wherein said abnormality determining means determines whether there is an abnormality in said evaporative emission control system based upon said output from said pressure detecting means, when said engine is in said predetermined operating condition, and at the same time it is detected by said vehicle speed detecting means that said vehicle is in a substantially standing condition.

8. An abnormality diagnostic system as claimed in any one of claims 1, 2, 3, 4 or 5, including engine operation detecting means for detecting whether said engine is operating, a second control valve arranged across said evaporative fuel-guiding passage, and a third control valve for opening and closing said air inlet port of said canister and wherein said negatively pressurizing means brings said evaporative emission control system into said predetermined negatively pressurized state by controlling said first to third control valves while said engine is detected to be operating.

9. An abnormality diagnostic system as claimed in any one of claims 1, 2, 3, 4 or 5, wherein said abnormality determining means determines whether there is an abnormality in said evaporative emission control system, based upon a rate of change in said pressure within said evaporative emission control system with the lapse of time after said evaporative emission control system has been brought into said predetermined negatively pressurized state by said negatively pressurizing means.

10. In an abnormality diagnostic system for an evaporative fuel-processing system for an internal combustion engine installed in a vehicle and having an intake system, and a fuel tank, the system comprising an evaporative emission-control system including a canister having an air inlet port provided therein, an evaporative fuel-guiding passage extending between said fuel tank and said canister, a purging passage extending between said canister and said intake system of said engine, and a first control valve arranged across said purging passage, the improvement comprising:

pressure detecting means for detecting pressure within said evaporative emission control system;

negatively pressurizing means for bringing said evaporative emission control system into a predetermined negatively pressurized state;

external diagnostic means provided externally of said vehicle, said external diagnostic means being humanly operable for diagnosing operating conditions of said engine, said external diagnostic means for generating a command signal for carrying out an abnormality diagnosis of said evaporative emission control system when said engine is in a predetermined operating condition suitable for said abnormality diagnosis of said evaporative emission control system; and abnormality determining means responsive to said command signal from said external diagnostic means, for determining whether there is an abnormality in said evaporative emission control system based upon an output from said pressure detecting means, which output is obtained when said evaporative emission control system has been brought into said predetermined negatively pressurized state, when said engine is in said predetermined operation condition.

11. An abnormality diagnostic system as claimed in claim 10, wherein said external diagnostic means is disconnectibly connected to said vehicle.

* * * * *